US007309220B2

(12) United States Patent
Hwang et al.

(10) Patent No.: US 7,309,220 B2
(45) Date of Patent: Dec. 18, 2007

(54) BACK PRESSURE APPARATUS FOR ORBITING VANE COMPRESSORS

(75) Inventors: Seon-woong Hwang, Anyang-Si (KR); Dong-won Yoo, Seoul (KR); In-hwe Koo, Seongnam-Si (KR)

(73) Assignee: LG Electronics Inc., Seoul (KR)

( * ) Notice: Subject to any disclaimer, the term of this patent is extended or adjusted under 35 U.S.C. 154(b) by 89 days.

(21) Appl. No.: 11/208,719

(22) Filed: Aug. 23, 2005

(65) Prior Publication Data

US 2006/0127263 A1 Jun. 15, 2006

(30) Foreign Application Priority Data

Dec. 14, 2004 (KR) ..... 10-2004-0105637

(51) Int. Cl.
*F01C 1/02* (2006.01)
*F01C 1/063* (2006.01)

(52) U.S. Cl. ..... 418/57; 418/55.5

(58) Field of Classification Search ..... 418/55.1–55.6, 418/59; 417/283, 307–311, 228, 440
See application file for complete search history.

(56) References Cited

U.S. PATENT DOCUMENTS 4,596,520 A * 6/1986 Arata et al. ..... 418/55.5
4,645,437 A * 2/1987 Sakashita et al. ..... 418/55.5
4,958,993 A * 9/1990 Fujio ..... 418/55.3
5,607,288 A * 3/1997 Wallis et al. ..... 417/310
5,855,475 A * 1/1999 Fujio et al. ..... 418/15
6,077,057 A * 6/2000 Hugenroth et al. ..... 418/55.4
6,299,417 B1 * 10/2001 Shin et al. ..... 417/439
6,389,837 B1 * 5/2002 Morozumi ..... 62/324.6
6,589,035 B1 * 7/2003 Tsubono et al. ..... 418/55.5
6,679,690 B2 * 1/2004 Fushiki et al. ..... 418/55.5
7,137,796 B2 * 11/2006 Tsubono et al. ..... 418/55.5
7,163,386 B2 * 1/2007 Tsuchiya et al. ..... 418/55.5
2004/0211203 A1 * 10/2004 Murase et al. ..... 62/226

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is a back pressure apparatus for orbiting vane compressors that is capable of reducing excessive axial force applied to an orbiting vane due to high-pressure refrigerant gas introduced to the lower surface of a vane plate of the orbiting vane. The back pressure apparatus comprises a back pressure chamber formed at the upper surface of a main frame, which is brought into tight contact with the lower surface of a vane plate of an orbiting vane, and a low-pressure gas communication part for allowing the back pressure chamber and an inlet port to communicate with each other therethrough. Consequently, the present invention has the effect of preventing excessive friction between the orbiting vane and the inner surface of a cylinder, preventing damage to the orbiting vane compressor due to the friction, and preventing deterioration of performance of the orbiting vane compressor due to the frictional loss.

16 Claims, 8 Drawing Sheets

BACK PRESSURE APPARATUS FOR ORBITING VANE COMPRESSORS

BACKGROUND OF THE INVENTION

1. Field of the Invention

The present invention relates to an orbiting vane compressor, and, more particularly, to a back pressure apparatus for orbiting vane compressors that is capable of reducing excessive axial force applied to an orbiting vane due to high-pressure refrigerant gas introduced to the lower surface of a vane plate of the orbiting vane.

2. Description of the Related Art

Referring to FIG. 1, there is illustrated a conventional orbiting vane compressor. As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, respectively, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the upper part thereof. The crank pin 81 is fixedly fitted in the boss 55 of the orbiting vane 5. As the orbiting vane 5 performs an orbiting movement in a cylinder 4, refrigerant gas introduced into the cylinder 4 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

Unexplained reference numeral 1*a* indicates an inlet tube, 1*b* a high-pressure chamber, and 1*c* an outlet tube.

FIG. 2 is an exploded perspective view illustrating main components of the conventional orbiting vane compressor shown in FIG. 1.

In the compression unit P, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

The crank pin 81 of the crankshaft 8 is fixedly fitted in the boss 55, which is formed at the upper part of a vane plate 50 of the orbiting vane 5. At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. At another predetermined position of the circumferential part of the circular vane 51 of the orbiting vane 5, which is adjacent to the position where the through-hole 52 is disposed, is formed an opening 53. A slider 54 is disposed in the opening 53.

FIG. 3 is a plan view, in section, illustrating the operation of the conventional orbiting vane compressor.

When the orbiting vane 5 of the compression unit P is driven by power transmitted to the compression unit P from the drive unit D through the crankshaft 8 (See FIG. 1), the circular vane 51 of the orbiting vane 5 disposed in the annular space 42 of the cylinder 4 performs an orbiting movement in the annular space 42 of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2 through the inner outlet port 44.

At the 90-degree orbiting position of the orbiting vane 5 of the compression unit P, the compression is still performed in the outer compression chamber B2, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 through the outer outlet port 44*a*, and the compression is still performed in the inner compression chamber A2. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is performed in a continuous fashion.

The slider 54 is slidably disposed in the opening 53 for maintaining the seal between the inner and outer compression chambers A2 and B2.

In the conventional orbiting vane compressor with the above-stated construction, however, excessive upward axial force, i.e., excessive axial lifting force is applied to the orbiting vane due to high-pressure refrigerant gas introduced to the lower surface of the vane plate of the orbiting vane. As a result, interference occurs between the upper surface of the orbiting vane and the inner surface of the cylinder, and therefore, excessive friction occurs between the orbiting vane and the cylinder.

The excessive friction between the orbiting vane and the cylinder causes frictional loss during the orbiting movement of the orbiting vane. Consequently, performance of the orbiting vane compressor is deteriorated.

SUMMARY OF THE INVENTION

Therefore, the present invention has been made in view of the above problems, and it is an object of the present invention to provide a back pressure apparatus for orbiting vane compressors that is capable of reducing excessive axial force applied to an orbiting vane due to high-pressure refrigerant gas introduced to the lower surface of a vane plate of the orbiting vane.

In accordance with the present invention, the above and other objects can be accomplished by the provision of a back pressure apparatus for orbiting vane compressors, comprising: an inlet port formed at a predetermined position of the circumferential part of a cylinder for allowing refrigerant gas to be introduced into the cylinder therethrough; an annular space defined between an inner ring and an inner wall of the cylinder; an orbiting vane disposed in the annular space of the cylinder for compressing the refrigerant gas introduced into the cylinder and discharging the compressed refrigerant gas out of the cylinder, the orbiting vane having a vane plate and a circular vane integrally formed at the upper part of the vane plate; and a back pressure mechanism disposed under the lower surface of the vane plate for storing refrigerant gas whose pressure is lower than that of the compressed refrigerant gas at the upper surface of the vane plate.

Preferably, the back pressure mechanism comprises: a back pressure chamber formed at the upper surface of a main frame, which is brought into tight contact with the lower surface of the vane plate; and a low-pressure gas communication part for replacing refrigerant gas in the back pressure chamber with low-pressure refrigerant gas.

Preferably, the low-pressure gas communication part comprises: a communication hole formed at the vane plate of the orbiting vane such that the back pressure chamber communicates with the annular space of the cylinder through the communication hole.

Preferably, the low-pressure gas communication part comprises: a discharge pipe connected between the back pressure chamber and the inlet port such that the back pressure chamber communicates with the inlet port through the discharge pipe.

Preferably, the back pressure mechanism further comprises: a pressure maintaining part for maintaining the pressure in the back pressure chamber below a predetermined level.

Preferably, the pressure maintaining part comprises: an opening/closing valve for opening or closing the discharge pipe based on the pressure in the back pressure chamber.

Preferably, the opening/closing valve comprises: an opening/closing chamber mounted on the discharge pipe such that the opening/closing chamber communicates with the discharge pipe; an opening/closing ball disposed in the opening/closing chamber at the lower end of the opening/closing chamber; and a resilient member disposed in the opening/closing chamber between the opening/closing ball and the upper end of the opening/closing chamber for resiliently supporting the opening/closing ball.

Preferably, the back pressure mechanism further comprises: a guide pipe connected between the back pressure chamber and the upper surface of the main frame for allowing refrigerant gas to be guided into the back pressure chamber therethrough; and a decompression valve mounted on the guide pipe for decompressing the high-pressure refrigerant gas guided into the back pressure chamber through the guide pipe.

Preferably, the back pressure mechanism further comprises: a sealing part disposed at the circumference of the back pressure chamber for hermetically sealing the back pressure chamber.

Preferably, the sealing part comprises: at least one insertion groove formed at the upper surface of the main frame along the circumference of the back pressure chamber; and at least one sealing member inserted in the at least one insertion groove such that the at least one sealing member is brought into tight contact with the lower surface of the vane plate of the orbiting vane.

Preferably, the at least one sealing member is made of an airtight synthetic rubber material.

Preferably, the back pressure chamber is formed at the upper surface of the main frame, which is brought into tight contact with the lower surface of the vane plate of the orbiting vane, in the shape of a circular groove.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
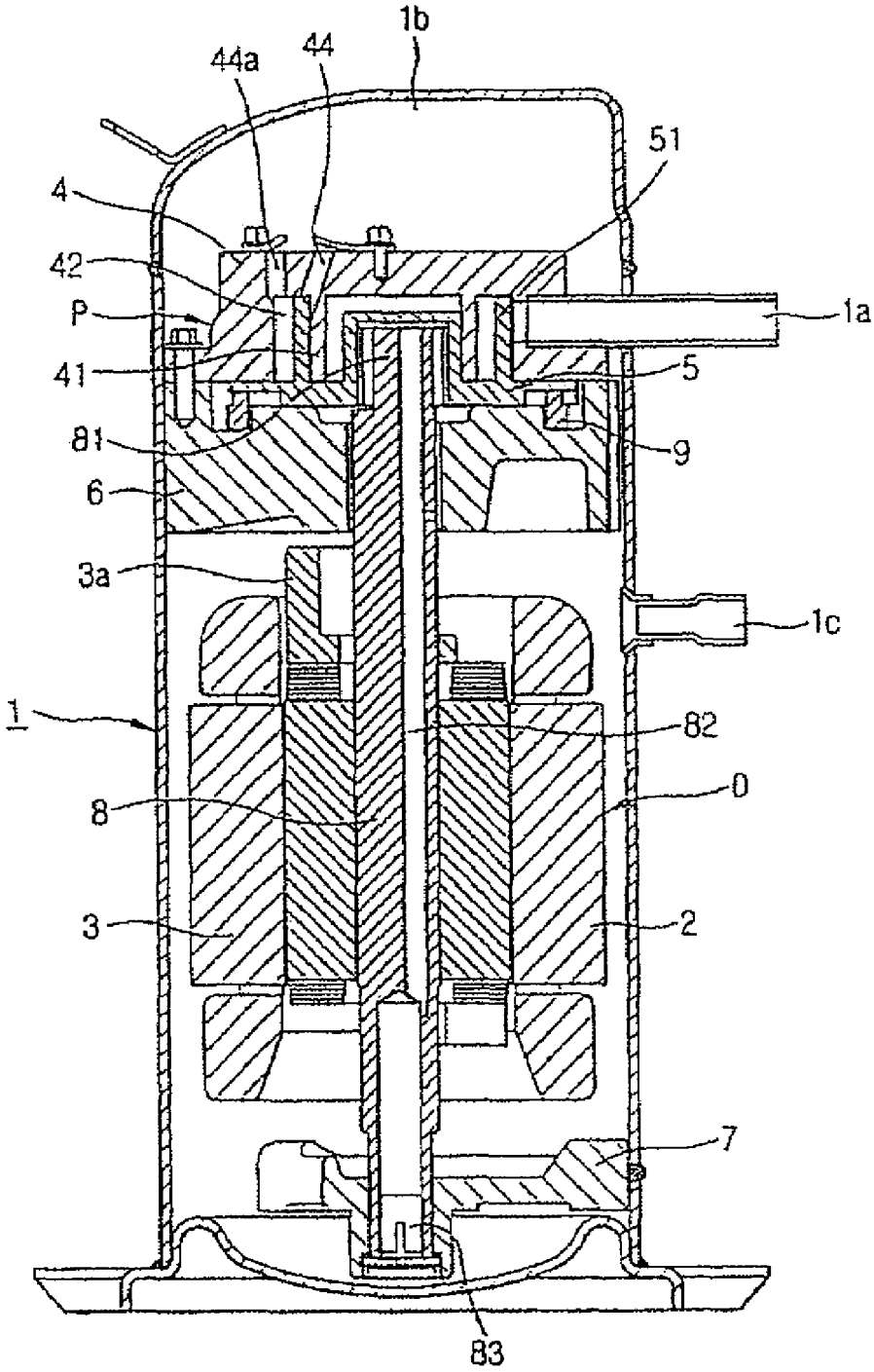
Fig.1 Conventional Art
FIG. 1 is a longitudinal sectional view illustrating the overall structure of a conventional orbiting vane compressor.
Figure 2:
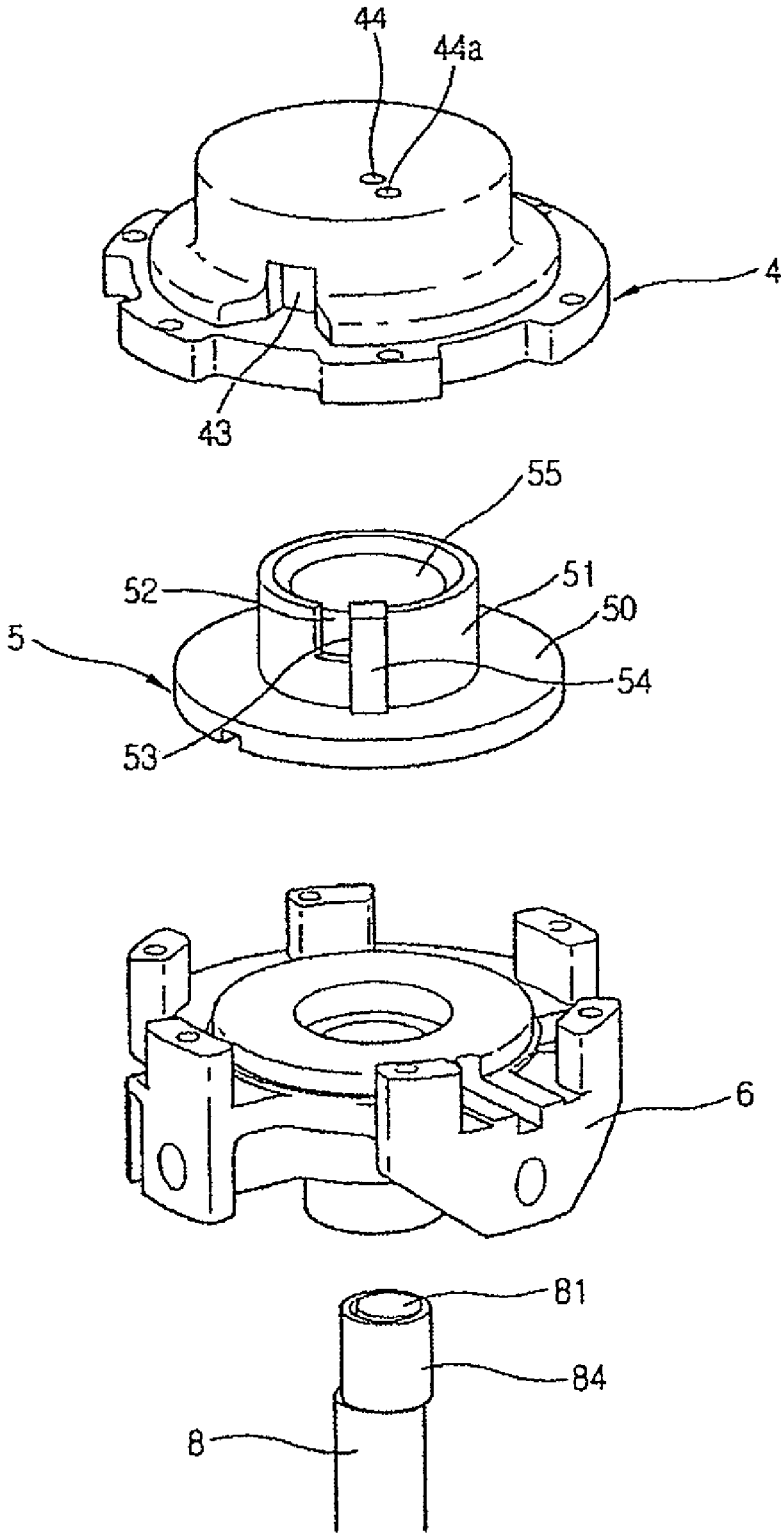
Fig.2 Conventional Art
FIG. 2 is an exploded perspective view illustrating main components of the conventional orbiting vane compressor shown in FIG. 1.
Figure 3:
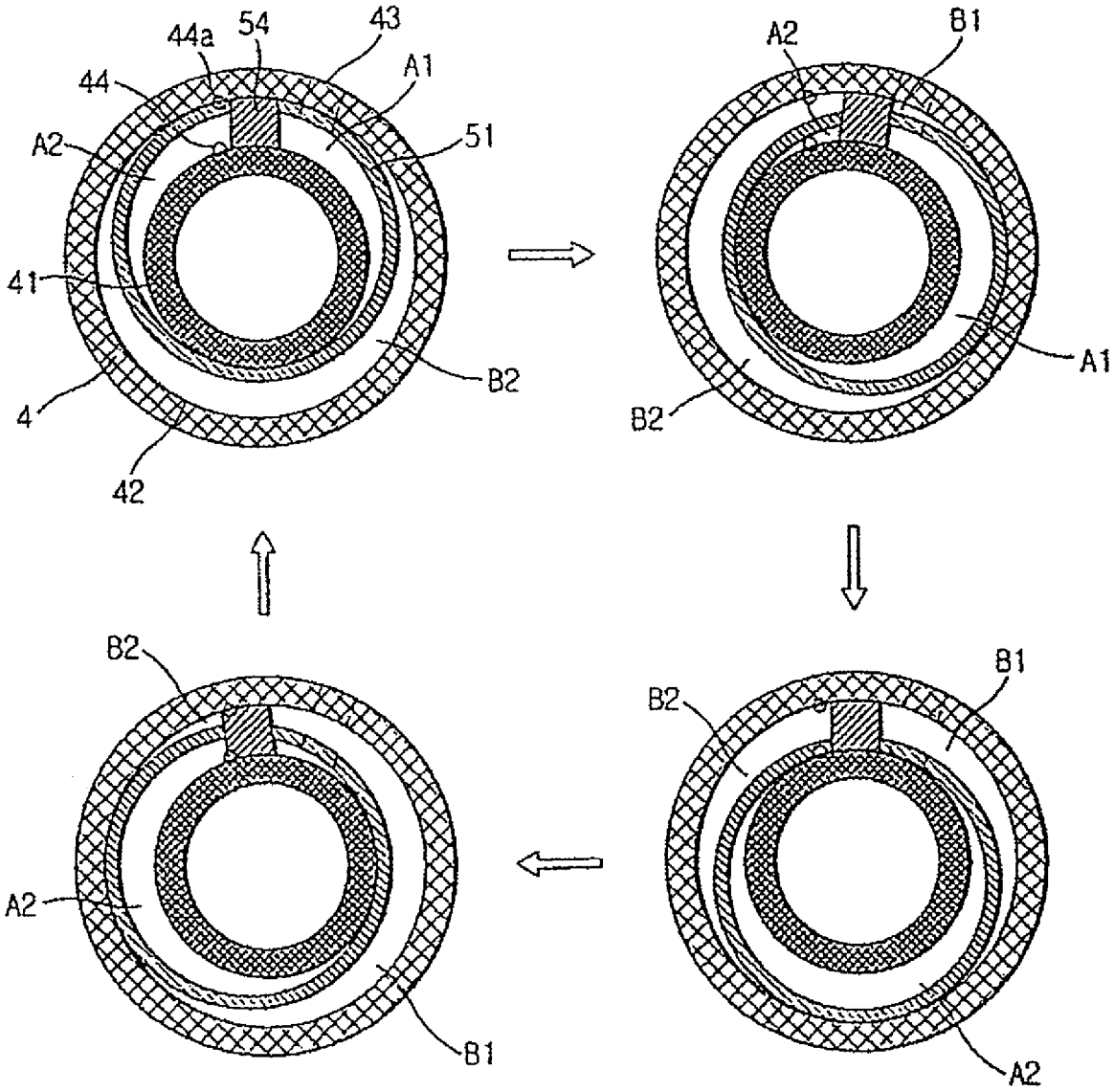
Fig.3 Conventional Art
FIG. 3 is a plan view, in section, illustrating the operation of the conventional orbiting vane compressor.
Figure 4:
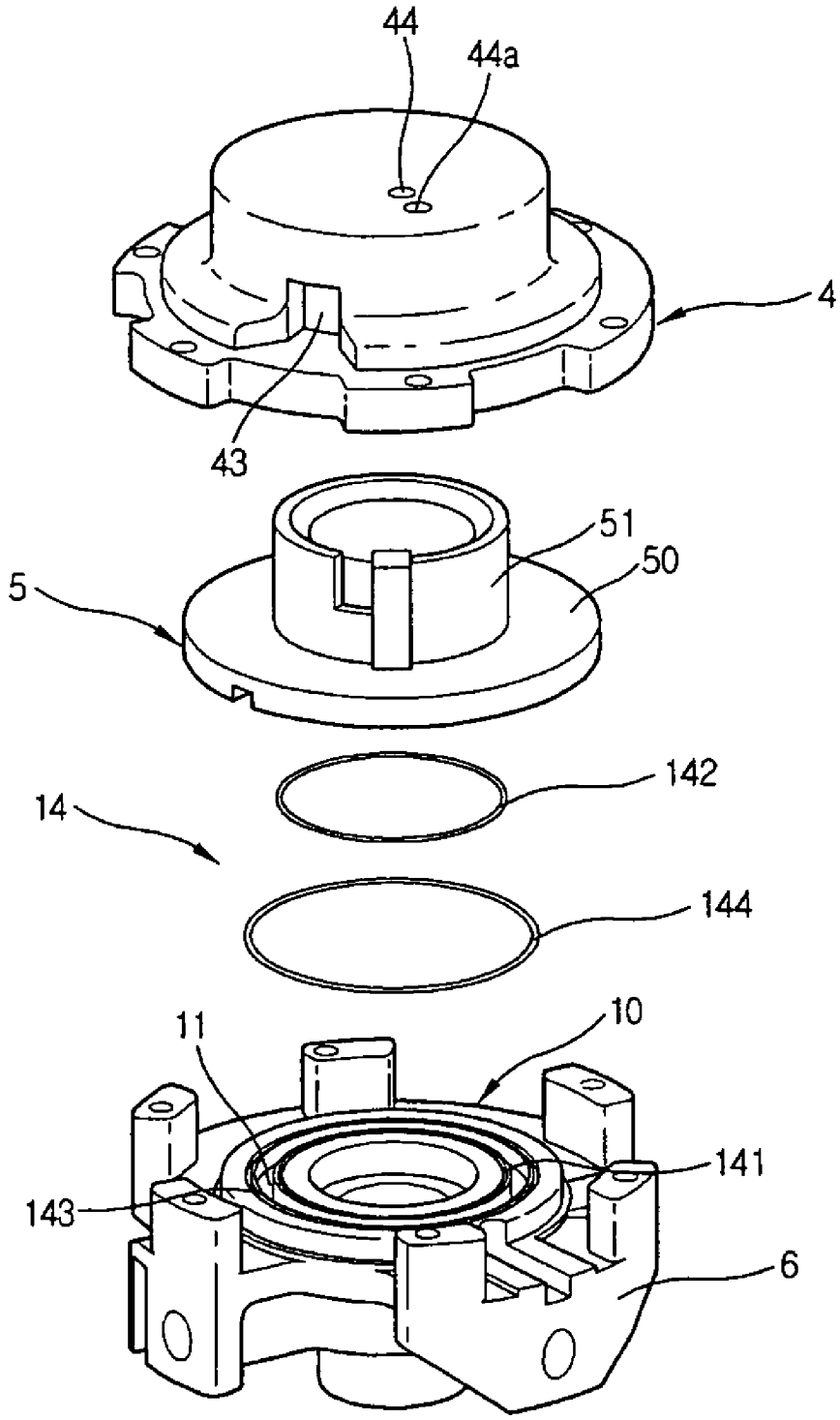
FIG. 4 is an exploded perspective view illustrating a back pressure apparatus for orbiting vane compressors according to a first preferred embodiment of the present invention.
Figure 5:
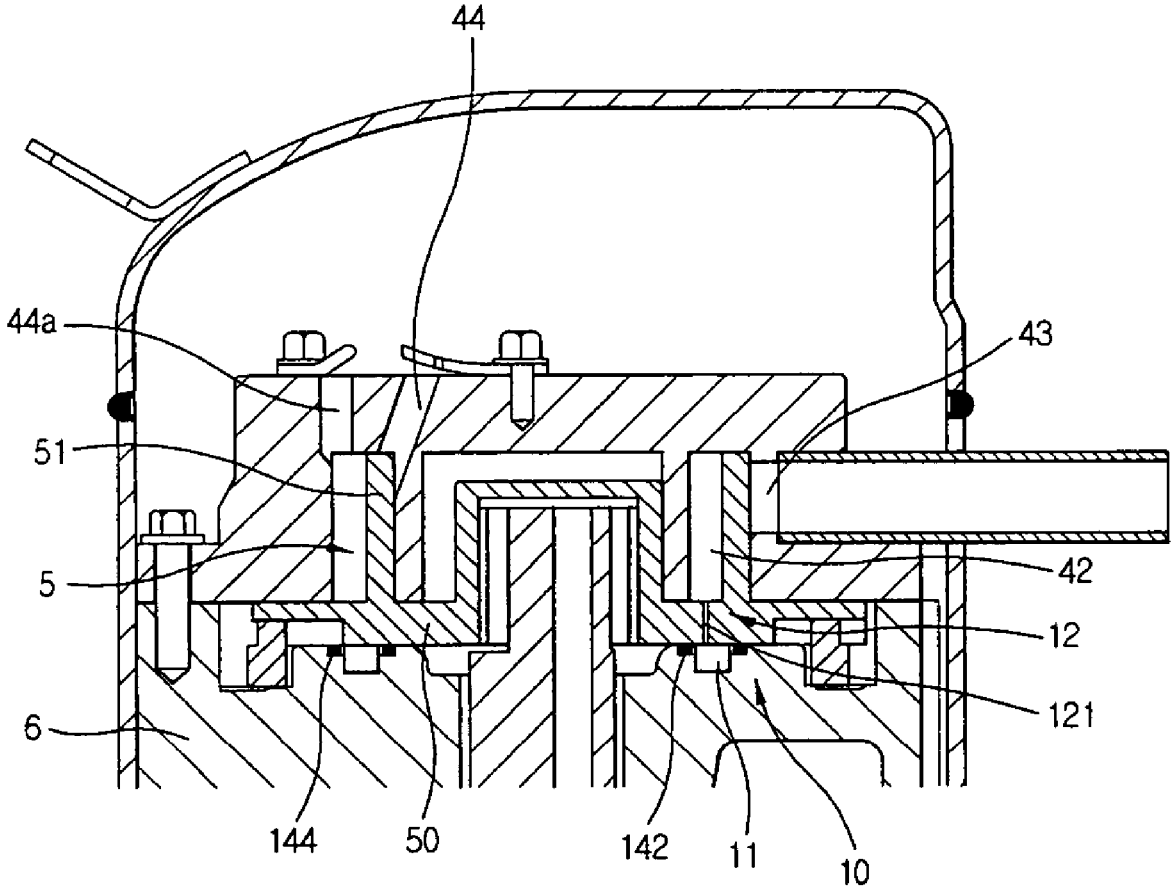
FIG. 5 is an assembled view, in longitudinal section, illustrating the back pressure apparatus for orbiting vane compressors according to the first preferred embodiment of the present invention.

FIG. 4 is an exploded perspective view illustrating a back pressure apparatus for orbiting vane compressors according to a first preferred embodiment of the present invention, and FIG. 5 is an assembled view, in longitudinal section, illustrating the back pressure apparatus for orbiting vane compressors according to the first preferred embodiment of the present invention.

As shown in FIGS. 4 and 5, the back pressure apparatus for orbiting vane compressors comprises a back pressure mechanism 10 disposed at the upper surface of a main frame 6 under a vane plate 50 of an orbiting vane 5.

The back pressure mechanism 10 is configured to create a low-pressure region, the pressure of which is relatively lower than that of high-pressure refrigerant gas created in an annular space 42 of a cylinder 4 through an orbiting movement of a circular vane 51 of the orbiting vane 5, at the lower surface of the vane plate 50 of the orbiting vane 5.

The back pressure mechanism 10 serves to reduce the size of a high-pressure region where high-pressure refrigerant gas, which is discharged out of the cylinder 4 through a pair of outlet ports 44 and 44*a* formed at the cylinder 4 as the circular vane 51 performs an orbiting movement in the cylinder 4, is filled at the lower surface of the vane plate 50 of the orbiting vane 5, and therefore, to create the above-mentioned low-pressure region, which corresponds to the reduced portion of the high-pressure region.

Since the low-pressure region is created at the lower surface of the vane plate 50 of the orbiting vane 5 by the back pressure mechanism 10, the axial lifting force applied to the orbiting vane due to high-pressure refrigerant gas is greatly reduced, and therefore, excessive friction between the orbiting vane 5 and the inner surface of the cylinder due to the axial lifting force applied to the orbiting vane is effectively prevented.

The back pressure mechanism 10 comprises: an annular back pressure chamber 11 formed at the upper surface of the main frame 6; and a low-pressure gas communication part 12 for introducing low-pressure refrigerant gas into the back pressure chamber 11.

As the low-pressure refrigerant gas is introduced into the back pressure chamber 11 through the low-pressure gas communication part 12, the low-pressure region is created at the lower surface of the vane plate 50 of the orbiting vane 5. Consequently, the axial lifting force applied to the orbiting vane 5 is reduced.

The back pressure chamber 11 is formed at the upper surface of the main frame 6, which is brought into tight contact with the lower surface of the vane plate 50, in the shape of a circular groove. Consequently, the back pressure chamber 11 is hermetically sealed by the lower surface of the vane plate 50.

The back pressure chamber 11 is a low-pressure space disposed at the lower surface of the vane plate 50 of the orbiting vane 5. Consequently, it is more preferable to apply optimal back pressure to the vane plate 50 of the orbiting vane 5 by appropriately adjusting the size and area of the back pressure chamber 11.

The low-pressure gas communication part 12 comprises a communication hole 121 formed at the vane plate 50 of the orbiting vane 5 such that the back pressure chamber 11 communicates with the annular space 42 of the cylinder 4, which communicates with an inlet port 43, through the communication hole 121.

Low-pressure refrigerant gas introduced into the annular space 42 of the cylinder 4 through the inlet port 43 is introduced into the back pressure chamber 11 through the communication hole 121. That is, the low-pressure refrigerant gas introduced through the inlet port 43 fills the back pressure chamber 11.

As the low-pressure refrigerant gas introduced through the inlet port 43 is introduced into the back pressure chamber 11 through the communication hole 121, and therefore, the low-pressure refrigerant gas fills the back pressure chamber 11, as described above, a low-pressure region is created at the lower surface of the vane plate 50 of the orbiting vane 5 by the refrigerant gas introduced into the back pressure chamber 11. Consequently, the axial lifting force applied to the orbiting vane 5 due to the high-pressure refrigerant gas is greatly reduced.

The back pressure mechanism 10 further comprises a sealing part 14 disposed at the circumference of the back pressure chamber 11 for hermetically sealing the back pressure chamber 11.

The sealing part 14 comprises: a sealing member 142 inserted in an insertion groove 141 formed at the upper surface of the main frame 6 along the inner circumference of the back pressure chamber 11; and another sealing member 144 inserted in another insertion groove 143 formed at the upper surface of the main frame 6 along the outer circumference of the back pressure chamber 11.

The sealing member 142 inserted in the insertion groove 141 and the sealing member 144 inserted in the insertion groove 143 are brought into tight contact with the lower surface of the vane plate 50 of the orbiting vane 5. Consequently, the back pressure chamber 11 formed at the upper surface of the main frame 6 under the lower surface of the vane plate 50 of the orbiting vane 5 is sealed, and at the same time, compressed refrigerant gas is prevented from leaking in the circumferential direction at the lower surface of the vane plate 50 of the orbiting vane 5.

Preferably, the sealing members 142 and 144 are made of durable and flexible synthetic rubber, by which the back pressure chamber 11 is securely sealed.

Figure 6:
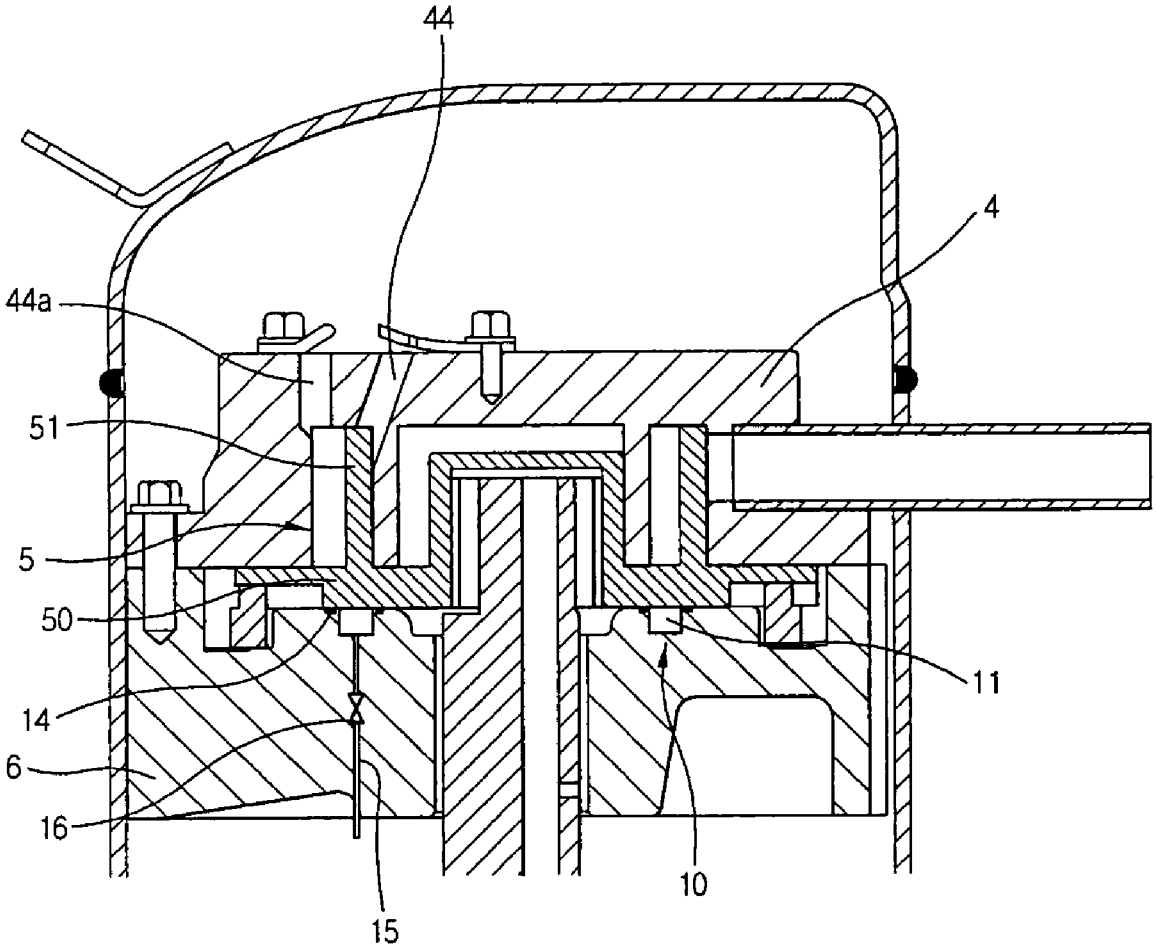
FIG. 6 is a longitudinal sectional view illustrating a back pressure apparatus for orbiting vane compressors according to a second preferred embodiment of the present invention.

FIG. 6 is a longitudinal sectional view illustrating a back pressure apparatus for orbiting vane compressors according to a second preferred embodiment of the present invention.

As shown in FIG. 6, the back pressure apparatus for orbiting vane compressors comprises a back pressure mechanism 10 disposed at the upper surface of a main frame 6 under a vane plate 50 of an orbiting vane 5.

The back pressure mechanism 10 comprises: an annular back pressure chamber 11 formed at the upper surface of the main frame 6; a guide pipe 15 for allowing refrigerant gas to be guided into the back pressure chamber 11 therethrough; a decompression valve 16 mounted on the guide pipe 15 for decompressing the high-pressure refrigerant gas guided into the back pressure chamber 11 through the guide pipe 15; and a sealing part 14 disposed at the circumference of the back pressure chamber 11 for hermetically sealing the back pressure chamber 11.

The back pressure chamber 11 is formed at the upper surface of the main frame 6, which is brought into tight contact with the lower surface of the vane plate 50, in the shape of a circular groove. Consequently, the back pressure chamber 11 is hermetically sealed by the lower surface of the vane plate 50.

The guide pipe 15 serves as a channel for allowing the high-pressure refrigerant gas, which is created by an orbiting movement of a circular vane 51 of the orbiting vane 5 and discharged out of a cylinder 4 through a pair of outlet ports 44 and 44*a*, to be guided into the back pressure chamber 11 from the outside of the main frame 6.

The decompression valve 16 serves to decompress the high-pressure refrigerant gas guided into the back pressure chamber 11 from the outside of the main frame 5 through the guide pipe 15.

The high-pressure refrigerant gas discharged out of the cylinder 4 and the main frame 6 through the outlet ports 44 and 44*a* is decompressed by the decompression valve 16, and then the decompressed refrigerant gas, i.e., the low-pressure refrigerant gas, is guided into the back pressure chamber 11 through the guide pipe 15. As a result, the low-pressure refrigerant gas fills the back pressure chamber 11.

As the high-pressure refrigerant gas is changed to low-pressure refrigerant gas through the guide pipe 15 and the decompression valve 16, and then the low-pressure refrigerant fills the back pressure chamber 11, a low-pressure region is created at the lower surface of the vane plate 50 of the orbiting vane 5 by the refrigerant gas guided into the back pressure chamber 11. Consequently, the axial lifting force applied to the orbiting vane 5 due to the high-pressure refrigerant gas is greatly reduced.

Figure 7:
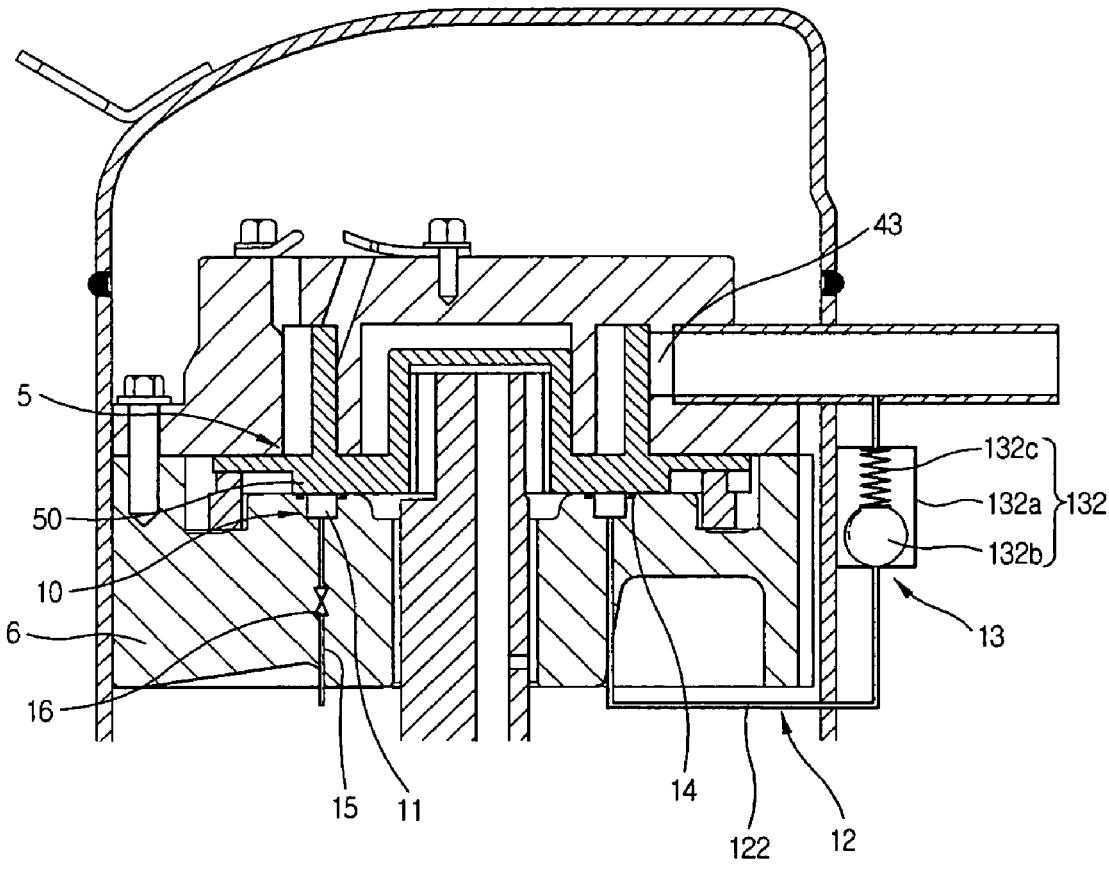
FIG. 7 is a longitudinal sectional view illustrating a back pressure apparatus for orbiting vane compressors according to a third preferred embodiment of the present invention.

FIG. 7 is a longitudinal sectional view illustrating a back pressure apparatus for orbiting vane compressors according to a third preferred embodiment of the present invention.

As shown in FIG. 7, the back pressure apparatus for orbiting vane compressors comprises a back pressure mechanism 10 disposed at the upper surface of a main frame 6 under a vane plate 50 of an orbiting vane 5.

The back pressure mechanism 10 comprises: an annular back pressure chamber 11 formed at the upper surface of the main frame 6; a low-pressure gas communication part 12 for discharging refrigerant gas out of the back pressure chamber 11; a pressure maintaining part 13 for maintaining the pressure in the back pressure chamber below a predetermined level; a sealing part 14 disposed at the circumference of the back pressure chamber 11 for hermetically sealing the back pressure chamber 11; a guide pipe 15 connected between the back pressure chamber 11 and the upper surface of the main frame 6 for allowing refrigerant gas to be guided into the back pressure chamber 11 therethrough; and a decompression valve 16 mounted on the guide pipe 15 for decompressing the high-pressure refrigerant gas guided through the guide pipe 15.

The low-pressure gas communication part 12 comprises a discharge pipe 122 connected between the back pressure chamber 11 and an inlet-port 43 such that the back pressure chamber 11 communicates with the inlet port 43, through which low-pressure refrigerant gas flows, through the discharge pipe 122.

The pressure maintaining part 13 comprises an opening/closing valve 132 mounted on the discharge pipe 122.

The high-pressure refrigerant gas is decompressed through the guide pipe 15 and the decompression valve 16, and then the decompressed refrigerant gas, i.e., the low-pressure refrigerant gas, fills the back pressure chamber 11. When the pressure of the low-pressure refrigerant gas in the back pressure chamber 11 exceeds a predetermined level, the opening/closing valve 132 is opened such that the refrigerant gas is discharged to the inlet port 43 from the back pressure chamber 11 through the discharge pipe 122.

When the back pressure chamber 11 does not serve as the low-pressure region as the pressure in the back pressure chamber 11 is increased, the pressure maintaining part 13 discharges the increased-pressure refrigerant gas into the inlet port 43 to maintain the pressure in the back pressure chamber 11 below the predetermined level such that the back pressure chamber 11 serves as the low-pressure region.

The opening/closing valve 132 comprises: an opening/closing chamber 132*a* mounted on the discharge pipe 122 such that the opening/closing chamber 132*a* communicates with the discharge pipe 122; an opening/closing ball 132*b* disposed in the opening/closing chamber 132*a* at the lower end of the opening/closing chamber 132*a*; and a resilient member 132*a* disposed in the opening/closing chamber 132*a* between the opening/closing ball 132 and the upper end of the opening/closing chamber 132*a* for resiliently supporting the opening/closing ball 132*b*.

When the pressure of the refrigerant gas in the back pressure chamber 11 is increased, the opening/closing ball 132*b* is moved upward in the opening/closing chamber 132*a* against the resilient force of the resilient member 132*c*. As a result, the discharge pipe 122 communicates with the inlet port 43, and therefore, the refrigerant gas is discharged to the inlet port 43 from the back pressure chamber 11 through the discharge pipe 122.

When the pressure of the refrigerant gas in the back pressure chamber 11 is decreased below a predetermined level, the opening/closing ball 132*b* is moved downward in the opening/closing chamber 132*a* by the resilient force of the resilient member 132*c* until the opening/closing ball 132*b* is brought into tight contact with the lower end of the opening/closing chamber 132*a*. As a result, communication between the discharge pipe 122 and the inlet port 43 is interrupted by the opening/closing ball 132*b*, and therefore, the refrigerant gas is not discharged to the inlet port 43 from the back pressure chamber 11.

Preferably, the resilient member 132*c* is formed in the shape of a coil spring, and the spring constant of the coil spring is set based on the predetermined pressure.

Figure 8:
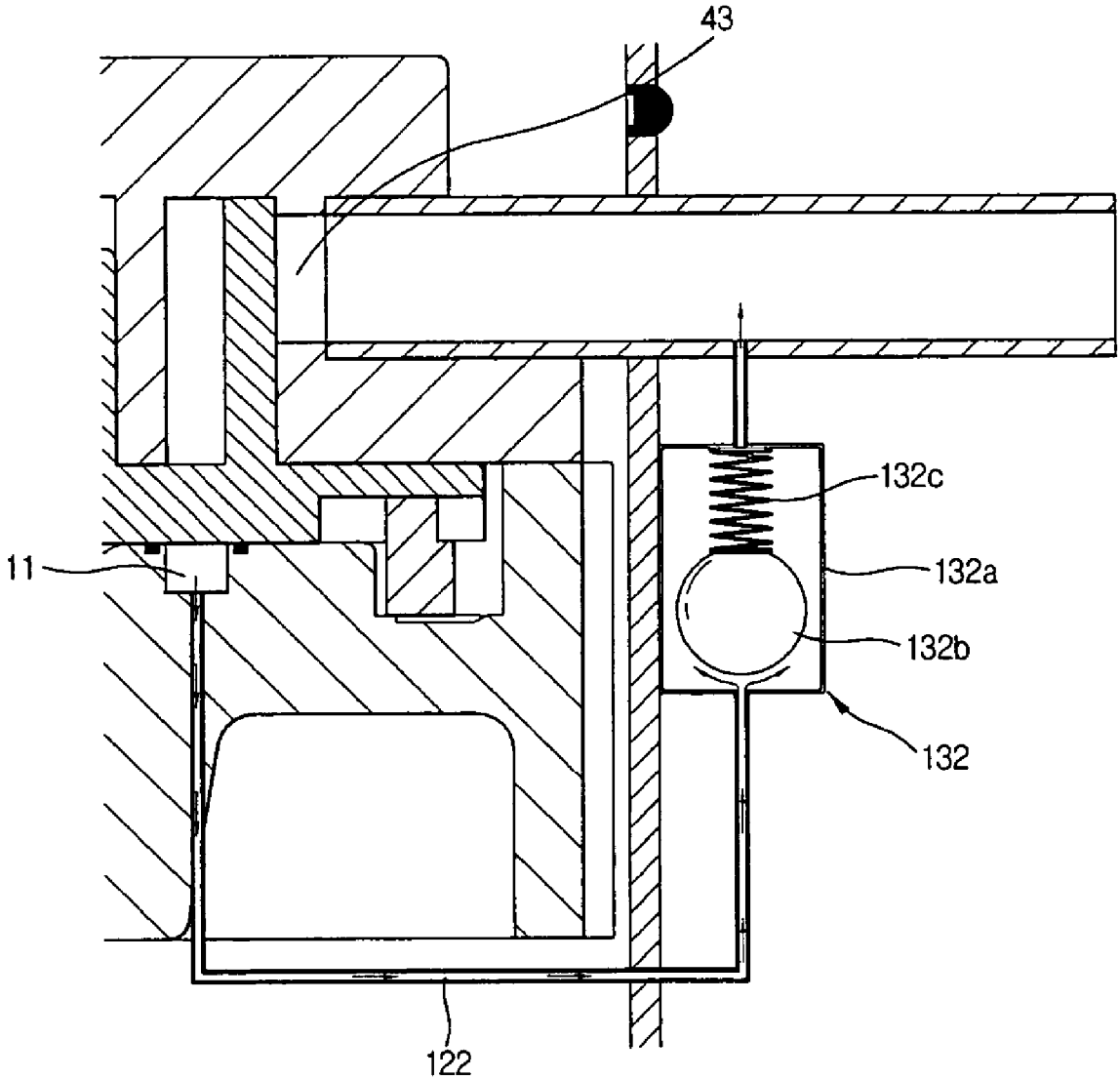
FIG. 8 is an enlarged view, in longitudinal section, illustrating the operation of the back pressure apparatus for orbiting vane compressors according to the third preferred embodiment of the present invention shown in FIG. 7.

FIG. 8 is an enlarged view, in longitudinal section, illustrating the operation of the back pressure apparatus for orbiting vane compressors according to the third preferred embodiment of the present invention shown in FIG. 7.

The opening/closing ball 132*b* is usually maintained in tight contact with the lower end of the opening/closing chamber 132*a* by the resilient force of the resilient member 132*c*. When the pressure in the back pressure chamber 11 is increased above the predetermined level, as shown in FIG. 8, the opening/closing ball 132*b* is moved upward in the opening/closing chamber 132*a* against the resilient force of the resilient member 132*c*, and therefore, the discharge pipe 122 communicates with the inlet port 43, which will be described hereinafter in more detail.

When the pressure in the back pressure chamber 11 is increased above the predetermined level, the high-pressure refrigerant gas flows to the opening/closing chamber 132*a* through the discharge pipe 122, and therefore, the opening/closing ball 132*b*, which is in tight contact with the lower end of the opening/closing chamber 132*a* by the resilient force of the resilient member 132*c*, is raised in the opening/closing chamber 132*a* against the resilient force of the resilient member 132*c*. As the opening/closing ball 132*b* is raised in the opening/closing chamber 132*a* against the resilient force of the resilient member 132*c*, the refrigerant gas is introduced into the opening/closing chamber 132*a*, and is then discharged to the inlet port 43 through the discharge pipe 122 connected to the inlet port side.

As the opening/closing ball 132*b* is raised by the refrigerant gas in the back pressure chamber 11, and therefore, the refrigerant gas is discharged to the inlet port 43, the pressure in the back pressure chamber 11 is decreased below the predetermined level. As a result, the resilient member 132 is returned to its original state, and therefore, the opening/closing ball 132*b* is moved downward until the opening/closing ball 132*b* is brought into tight contact with the lower end of the opening/closing chamber 132*a*. Consequently, communication between the discharge pipe 122 and the inlet port 43 is interrupted by the opening/closing ball 132*b*, and therefore, the refrigerant gas is not discharged to the inlet port 43 from the back pressure chamber 11.

As apparent from the above description, the excessive axial force applied to the orbiting vane due to high-pressure refrigerant gas introduced to the lower surface of the vane plate of the orbiting vane is greatly reduced. Consequently, the present invention has the effect of preventing excessive friction between the orbiting vane and the inner surface of the cylinder, preventing damage to the orbiting vane compressor due to the friction, and preventing deterioration of performance of the orbiting vane compressor due to the frictional loss.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A back pressure apparatus for orbiting vane compressors, comprising:

an inlet port provided at a predetermined position on a circumferential portion of a cylinder and configured for allowing refrigerant gas to be introduced into the cylinder through the inlet port;

an annular space defined between an inner ring and an inner wall of the cylinder;

an orbiting vane disposed in the annular space of the cylinder for compressing the refrigerant gas introduced into the cylinder and for discharging the compressed refrigerant gas from the cylinder, the orbiting vane having a vane plate and a circular vane integrally formed at an upper part of the vane plate; and a back pressure mechanism disposed under a lower surface of the vane plate and containing low-pressure refrigerant gas, a pressure of the low-pressure refrigerant gas being lower than a pressure of the compressed refrigerant gas;

wherein the back pressure mechanism comprises:

a back pressure chamber provided at an upper surface of a main frame, the back pressure chamber configured to be in tight contact with the lower surface of the vane plate; and a low-pressure gas communication part for introducing the low-pressure refrigerant gas into the back pressure chamber;

wherein the back pressure chamber is configured as a circular groove.

2. The apparatus as set forth in claim 1, wherein the low-pressure gas communication part comprises:

a communication hole provided in the vane plate of the orbiting vane such that the back pressure chamber communicates with the annular space of the cylinder through the communication hole.

3. The apparatus as set forth in claim 1, wherein the back pressure mechanism further comprises:

a sealing part disposed at the circumference of the back pressure chamber for hermetically sealing the back pressure chamber.

4. The apparatus as set forth in claim 3, wherein the sealing part comprises:

at least one insertion groove provided in the upper surface of the main frame along a circumference of the back pressure chamber; and at least one sealing member provided in the at least one insertion groove such that the at least one sealing member is in tight contact with the lower surface of the vane plate of the orbiting vane.

5. The apparatus as set forth in claim 4, wherein the at least one sealing member comprises an airtight synthetic rubber material.

6. The apparatus as set forth in claim 1, wherein the low-pressure gas communication part comprises:

a discharge pipe connected between the back pressure chamber and the inlet port such that the back pressure chamber communicates with the inlet port through the discharge pipe.

7. The apparatus as set forth in claim 6, wherein the back pressure mechanism further comprises:

a pressure maintaining part for maintaining the pressure in the back pressure chamber below a predetermined level.

8. The apparatus as set forth in claim 7, wherein the pressure maintaining part comprises:

an opening/closing valve for opening and closing the discharge pipe based on the pressure in the back pressure chamber.

9. The apparatus as set forth in claim 8, wherein the opening/closing valve comprises:

an opening/closing chamber mounted on the discharge pipe such that the opening/closing chamber communicates with the discharge pipe;

an opening/closing ball disposed in the opening/closing chamber at the lower end of the opening/closing chamber; and a resilient member disposed in the opening/closing chamber between the opening/closing ball and the upper end of the opening/closing chamber for resiliently supporting the opening/closing ball.

10. The apparatus as set forth in claim 7, wherein the back pressure mechanism further comprises:

a pipe connected between the back pressure chamber and the upper surface of the main frame for conveying refrigerant gas into the back pressure chamber.

11. The apparatus as set forth in claim 10, wherein the back pressure mechanism further comprises:

a decompression valve mounted on the pipe for decompressing the high-pressure refrigerant gas guided into the back pressure chamber through the pipe.

12. The apparatus as set forth in claim 6, wherein the back pressure mechanism further comprises:

a sealing part disposed at the circumference of the back pressure chamber for hermetically sealing the back pressure chamber.

13. The apparatus as set forth in claim 12, wherein the sealing part comprises:

at least one insertion groove provided in the upper surface of the main frame along a circumference of the back pressure chamber; and at least one sealing member provided in the at least one insertion groove such that the at least one sealing member is in tight contact with the lower surface of the vane plate of the orbiting vane.

14. The apparatus as set forth in claim 13, wherein the at least one sealing member comprises an airtight synthetic rubber material.

15. The apparatus as set forth in claim 1, said back pressure mechanism being configured to be distinct from bearings and bearing clearances.

16. The apparatus according to claim 1, said low-pressure gas communication part configured to replace refrigerant gas in the back pressure chamber with said low-pressure refrigerant gas.

* * * * *